US008865061B2

(12) United States Patent
Kaucke et al.

(10) Patent No.: US 8,865,061 B2
(45) Date of Patent: Oct. 21, 2014

(54) STEEL ALLOY FOR A LOW-ALLOY STEEL FOR PRODUCING HIGH-STRENGTH SEAMLESS STEEL TUBING

(75) Inventors: Christoph Kaucke, Düsseldorf (DE); Guido Kubla, Bottrop (DE); Heinz Sanders, Mülheim (DE); Charles Stallybrass, Düsseldorf (DE); André Schneider, Mönchengladbach (DE); Markus Schütz, Gladbeck (DE)

(73) Assignee: Vallourec Deutschland GmbH, Duesseldorf (DE)

( * ) Notice: Subject to any disclaimer, the term of this patent is extended or adjusted under 35 U.S.C. 154(b) by 113 days.

(21) Appl. No.: 12/918,457

(22) PCT Filed: Jan. 23, 2009

(86) PCT No.: PCT/DE2009/000088

§ 371 (c)(1),
(2), (4) Date: Nov. 22, 2010

(87) PCT Pub. No.: WO2009/103259

PCT Pub. Date: Aug. 27, 2009

(65) Prior Publication Data

US 2011/0315277 A1 Dec. 29, 2011

(30) Foreign Application Priority Data

Feb. 20, 2008 (DE) ..... 10 2008 010 749

(51) Int. Cl.

| | |
|---|---|
| ***C22C 38/12*** | (2006.01) |
| ***C22C 38/46*** | (2006.01) |
| ***C22C 38/50*** | (2006.01) |
| ***C22C 38/22*** | (2006.01) |
| ***C22C 38/44*** | (2006.01) |

(52) U.S. Cl.
CPC ..... *C22C 38/22* (2013.01)
USPC ..... 420/111; 420/109; 420/110; 420/113; 420/114; 148/334; 148/335

(58) Field of Classification Search
CPC ..... C21D 9/08; C22C 38/02; C22C 38/04; C22C 38/12; C22C 38/18; C22C 38/22; C22C 38/24; C22C 38/26; C22C 38/38; C22C 38/40; C22C 38/44; C22C 38/46; C22C 38/48; C22C 38/50; C22C 38/58
USPC ..... 420/105, 109–114, 122–124, 127, 128; 148/334, 335
See application file for complete search history.

(56) References Cited

U.S. PATENT DOCUMENTS

2002/0150497 A1* 10/2002 Hagen et al. ..... 420/90

FOREIGN PATENT DOCUMENTS

| | | | |
|---|---|---|---|
| CA | 2622410 | A1 * | 3/2007 |
| DE | 36 28 712 | A1 | 2/1988 |
| DE | 44 46 709 | A1 | 6/1996 |
| DE | 199 42 641 | A1 | 3/2001 |
| WO | WO 2007/033635 | A | 3/2007 |

OTHER PUBLICATIONS

Moze et al: "Net cross-section design resistance and local ductility of elements made of high-strength steel", in: J. of Constructional Steel Research, vol. 63, No. 11, Sep. 16, 2007, pp. 1431-1441.
Dilthey et al.: "Unterpulverschweissen der hochfesten Feinkornbaustähle S890QL und S960QL", in: Schweissen und Schneiden, DVS Verlag, vol. 52, No. 9, Sep. 1, 2000, pp. 546-548.
C. Ackermann: "Brückenbauen mit neuen Werkstoffen; Die Fussgängerbrücke über die Bayerstrasse in München", in: Stahlbau, vol. 74, No. 10, Oct. 2005, pp. 729-734.
"Brücke über die Bayerstrasse, München (Leichten Fusses zur Wiesn)", in: VM Report, vol. 15, Jun. 2005, pp. 1-3.

* cited by examiner

*Primary Examiner* — Roy King
*Assistant Examiner* — Caitlin Kiechle
(74) *Attorney, Agent, or Firm* — Henry M. Feiereisen LLC.

(57) ABSTRACT

The invention relates to a steel alloy for a low alloy steel for producing high-tensile, weldable, hot-rolled seamless steel tubing, in particular construction tubing. The chemical composition (in % by mass) is: 0.15-0.18% C; 0.20-0.40% Si; 1.40-1.60% Mn; max. 0.05% P; max. 0.01% S; >0.50-0.90% Cr; >0.50-0.80% Mo; >0.10-0.15% V; 0.60-1.00% W; 0.0130-0.0220% N; the remainder is made up of iron with production-related impurities; with the optional addition of one or more elements selected from Al, Ni, Nb, Ti, with the proviso that the relationship V/N has a value of between 4 and 12 and the Ni content of the steel is not more than 0.40%.

6 Claims, No Drawings

STEEL ALLOY FOR A LOW-ALLOY STEEL FOR PRODUCING HIGH-STRENGTH SEAMLESS STEEL TUBING

CROSS-REFERENCES TO RELATED APPLICATIONS

This application is the U.S. National Stage of International Application No. PCT/DE2009/000088, filed Jan. 23, 2009, which designated the United States and has been published as International Publication No. WO 2009/103259 and which claims the priority of German Patent Application, Serial No. 10 2008 010 749.2, filed Feb. 20, 2008, pursuant to 35 U.S.C. 119(a)-(d).

BACKGROUND OF THE INVENTION

The invention relates to a steel alloy for a low-alloy steel for producing high-strength seamless steel.

In particular, the invention relates to tubing which can also have cross-sections other than circular and which can be used as construction tubing for particularly highly stressed welded steel structures, for example, in the construction of cranes, bridges, ships, hoists and trucks.

Such tubing can, in addition to circular cross sections, also have square, rectangular or polygonal cross sections depending on the requirements and application.

Steel alloys for this type of steel tubing are known, for example, from DE 199 42 641 A1. This conventional steel alloy has, in addition to small added amounts of chromium, molybdenum and vanadium and the absence of nickel, an additional amount of tungsten in a range of 0.30-1.00%, which is particular for a low-alloy steel.

Eliminating the otherwise absolutely necessary nickel and/or at least limiting the nickel content to low concentrations is intended to prevent tacky scale and to improve the surface quality, in particular during warm-pilgering of tubing made from these types of steels, and to avoid the otherwise required expensive finish processing of the surface by cutting.

Construction tubing for the aforementioned applications is subject to very stringent requirements with respect to strength and ductility at low temperatures down to −40° C.

To attain the required properties, the tubes must be hardened and tempered after hot-rolling.

The steel known from DE 199 42 641 A1 as FGS 70 reliably attains all minimum values required for elasticity limit, tensile strength, elongation at rupture and notched bar impact work.

However, the requirements for construction tubing for the aforementioned applications have steadily increased over the past years, so that presently construction tubing meeting the following requirements is increasingly demanded:

elasticity limit 960 MPa,
tensile strength 980-1150 MPa,
notched bar impact work 27 J at −40° C.,
assured general weldability,
low or limited Ni-content.

The required increase in the strength with a sufficient ductility of the hot-processed seamless tubing for the aforedescribed applications requires the development of new alloying concepts. In particular, conventional alloying concepts do not attain sufficient ductility at low temperatures in the elasticity limit region around 1000 MPa.

The mechanism responsible for increasing the strength, which at the same time also leads to an increase in the ductility, is known to be a decrease in the grain size. The grain size can be reduced, for example, by additionally alloying nickel or molybdenum and the associated reduction of the transformation temperature.

These alloying concepts, however, cause the carbon equivalent to increase and therefore result in poorer weldability. Nickel and molybdenum also significantly increase the alloying costs, while nickel additionally degrades the surface quality of the hot-rolled tubing.

However, raising the carbon content as an obvious possibility for increasing the strength would lead to a deterioration of the ductility and a significant increase of the carbon equivalent.

Vanadium is also used for increasing the strength. This concept is based on the mixed-crystal-hardening of the vanadium and the precipitation of very fine vanadium-carbides during the tempering treatment.

However, the aforementioned alloying concepts were unable to attain the required properties.

A reduction of the grain size for improving the mechanical properties can basically also be achieved by thermo-mechanical treatment.

The specific temperature profile during hot-finishing of seamless tubing, however, does not permit the required reduction in the transformation temperature so that conventional concepts for thermo-mechanical treatment can be applied.

Until now, the required stringent requirements can only be attained with high-alloy steels, which has found no or only limited acceptance in the market due to their high costs.

It is an object of the invention to provide a low-cost steel alloy for a low-alloy steel for producing high-strength weldable seamless steel piping, in particular construction piping, which reliably satisfies the aforementioned minimum requirements with respect to elasticity limit, tensile strength, and notched bar impact work and which in addition ensures good general weldability and which produces optically flawless surfaces during hot-rolling.

SUMMARY OF THE INVENTION

According to the teaching of the invention, a steel for a low-alloy steel for producing high-strength, weldable, hot-rolled, seamless steel tubing, in particular construction tubing alloy is proposed, which has the following chemical composition:

0.15-0.18% C,
0.20-0.40% Si,
1.40-1.60% Mn,
max. 0.05% P,
max. 0.01% S,
>0.50-0.90% Cr,
>0.50-0.80% Mo,
>0.10-0.15% V,
0.60-1.00% W,
0.0130-0.0220% N,
remainder iron with melt-related impurities, with optional addition of one or more elements selected from Al, Ni, Nb, and Ti, with the proviso that the ratio V/N has a value of 4 to 12 and the nickel content of the steel is not more than 0.40%.

BRIEF DESCRIPTION OF THE DRAWING

None

DETAILED DESCRIPTION OF PREFERRED EMBODIMENTS

None

The steel alloy according to the invention improves over the development of the tungsten-alloyed fine-grain structural steel disclosed in DE 199 42 641 A1.

Experiments to date have not shown that tungsten negatively impacts weldability. However, according to tests, the maximum attainable increase in the elongation limit by alloying with tungsten is only ensured up to about 900 MPa. A further increase is not possible simply by increasing only the tungsten content. A W-content of 0.60-1.0%, preferably of the 0.7-0.9%, has therefore proven to be advantageous.

Surprisingly, tests performed in the context of the present invention have shown that with an only slightly higher addition of alloy elements, such as Cr and Mo, compared to a conventional steel alloy, and by adhering to certain V/N ratios, a significant increase in the strength is attained, while still complying within the required notched bar impact work of 27 J at −40° C.

It has been observed, that for attaining a certain "basic strength" the sum of the additions of Cr, Mo and W should be at least 1.5 wt.-%.

The invention has the innovative concept of raising the recrystallization stop temperature significantly above the final rolling temperature by targeted micro-alloying with vanadium and nitrogen. Based on extensive thermodynamic calculations, the ratio of the contents of V and N must be between 4 and 12 to attain the desired effect.

In general, a high content of dissolved nitrogen is viewed as being detrimental for the ductility. However, the concentration of dissolved nitrogen can be reduced to a minimum through suitable selection of the V/N ratio in a range from 4-12, while the formed vanadium carbonitrites simultaneously have the aforedescribed effect of grain refining through thermo-mechanical treatment.

The unusually high nitrogen content of the alloy, which is rendered harmless with the formation of vanadium carbonitrites or which is used for grain refining, advantageously also obviates the need for cost-intensive degassing treatments in the context of the secondary metallurgy.

In the context of the alloying concept according to the invention and depending on the requirements, an optional addition of one or more alloy elements of Al, Ni, Nb and Ti through alloying is provided. These requirements can be the result of, for example, different wall thicknesses of the tubing to be rolled, which may be in a range from less than 10 mm to more than 80 mm and which may require, in particular for greater wall thicknesses, addition of the aforementioned elements by alloying in order to attain the required properties by grain refining.

With respect to an optimal cost-benefit relation of the alloying concept, contents of max. 0.03% Al, max. 0.40% Ni, max. 0.04% Nb, and max. 0.04% Ti have proven to be advantageous.

The Ni-content is very low with a maximum of 0.40% so as to produce a surface of sufficiently good quality with the continuous tube rolling process used for this class of steel.

When using the hot-pilgering process for producing seamless tubing, the Ni content for attaining a surface of sufficiently good quality is limited to 0.2%, preferably 0.15%, in particular maximally 0.10%.

The steel tubing produced from a process melt with the steel alloy according to the invention listed below has excellent strength and ductility values.

0.17% C,
0.32% Si,
1.54% Mn,
0.013% P,
0.003% S,
0.74% Cr,
0.54% Mo,
0.11% V,
0.75% W,
0.0142% N,
0.023% Al,
0.16% Ni,
0.001% Ti,
with V/N=8.03.

Therefrom, the values listed in the following Table were determined. The values are average values determined from four tensile tests and from four notched bar impact bending work samples. The samples were taken from longitudinal samples of heat-treated tubing produced with the process.

| Geometry (OD × WD) | $R_{p0,2}$ | $R_m$ | $R_{p0,2}/R_m$ | $A_5$ | $A_v$ (at −40° C.) |
|---|---|---|---|---|---|
| 88.9 × 5.8 mm | 1070 MPa | 1128 MPa | 0.95 | 14.1% | 40 J |
| 88.9 × 5.8 mm | 1047 MPa | 1107 MPa | 0.95 | 13.0% | 41 J |
| 177.8 × 12.6 mm | 1067 MPa | 1092 MPa | 0.98 | 15.5% | 42 J |
| 177.8 × 12.6 mm | 1076 MPa | 1103 MPa | 0.98 | 17.0% | 37 J |
| Requirements | >960 MPa | 980-1150 MPa | | >10% | >27 J |

OD: outside diameter;
WD: wall thickness.

The invention claimed is:

1. A steel alloy for a low-alloy steel for producing high-strength, weldable, hot-rolled seamless steel tubing, comprising in mass-%:

0.15-0.18% C,
0.20-0.40% Si,
1.40-1.60% Mn,
max. 0.05% P,
max. 0.01% S,
>0.50-0.90% Cr,
>0.50-0.80% Mo,
>0.10-0.15% V,
0.60-1.00% W,
0.0130-0.0220% N,
one or more elements selected from Al, Ni, Nb, and Ti with a concentration of max. 0.03% Al, max. 0.40% Ni, max. 0.04% Nb, and max, 0.04% Ti, remainder iron with melt-related impurities, wherein a total content of added Cr, Mo and W is at least 1.6%, a ratio V/N has a value of 4 to 12 and a nickel content of the steel is not more than 0.40%.

2. The steel alloy of the claim 1, wherein W has a concentration of 0.7-0.9%.

3. The steel alloy of claim 1 wherein the steel alloy has a yield strength of more than 960 MPa.

4. A high-strength weldable seamless steel tubing produced by hot-rolling with subsequent hardening and tempering, comprising a steel having the following alloy composition in mass-%:

0.15-0.18% C,
0.20-0.40% Si, 1.40-1.60% Mn,
max. 0.05% P,
max. 0.01% S,
>0.50-0.90% Cr,
>0.50-0.80% Mo,
>0.10-0.15% V,
0.60-1.00% W,
0.0130-0.0220% N, with
$4 \leq V/N \leq 12$,
one or more elements selected from Al, Ni, Nb, and Ti, with
a total content of added Cr, Mo and W of at least 1.6%,
a nickel concentration of not more than 0.40%,
remainder iron with melt-related impurities.

5. The tubing of claim 4, wherein the one or more elements have the following concentration:
max. 0.03% Al,
max. 0.40% Ni,
max. 0.04% Nb,
max. 0.04% Ti.

6. The steel alloy of the claim 4, wherein W has a concentration of 0.7-0.9%.

* * * * *